United States Patent [19]

Jean Blanc

[11] Patent Number: 4,947,773

[45] Date of Patent: Aug. 14, 1990

[54] THREAD GUIDE RING FOR A NEEDLE BAR

[76] Inventor: Ferdinand H. Jean Blanc, 201 Main St., Harrison, Id. 83833

[21] Appl. No.: 384,170

[22] Filed: Jul. 20, 1989

[51] Int. Cl.[5] ..... D05B 55/00

[52] U.S. Cl. ..... 112/302; 112/225; 112/270

[58] Field of Search ..... 112/100, 101, 80.4, 112/221, 222, 223, 224, 225, 226, 227, 254, 281, 302, 310

[56] References Cited

U.S. PATENT DOCUMENTS

| | | | |
|---|---|---|---|
| 154,084 | 8/1874 | Rehfuss | 112/302 |
| 317,749 | 5/1885 | Dimond | 112/255 |
| 419,584 | 1/1890 | Coombs | 112/227 |
| 927,795 | 7/1909 | Haussler | 112/254 |
| 1,820,119 | 8/1931 | Chason | 112/254 X |
| 2,582,211 | 1/1952 | Turner | 112/254 |
| 2,692,569 | 10/1954 | Ketterer | 112/227 |
| 3,040,681 | 6/1962 | Kastrup | 112/302 |
| 4,246,857 | 1/1981 | Gonnai | 112/254 |
| 4,776,293 | 10/1988 | Yoshida | 112/302 |
| 4,886,004 | 12/1989 | Ogawa | 112/254 |

FOREIGN PATENT DOCUMENTS

| | | |
|---|---|---|
| 1059752 | 10/1957 | Fed. Rep. of Germany . |
| 0299847 | 6/1984 | France . |
| 0184133 | 5/1963 | Sweden . |
| 0184696 | 7/1963 | Sweden . |
| 0276111 | 9/1951 | Switzerland . |
| 0003769 | of 1875 | United Kingdom . |

*Primary Examiner*—Werner H. Schroeder
*Assistant Examiner*—Ismael Izaguirre
*Attorney, Agent, or Firm*—Delbert J. Barnard

[57] ABSTRACT

The upper end portion (44) of a needle (10) is received within a blind socket (38) which extends axially upwardly into a lower end portion of a needle bar (12). A set screw (42) is received within a set screw opening (40) which intersects the socket (38). The set screw (42) is tightened to secure the needle (10) to the needle bar (12). The lower end portion of needle bar (12) includes an inclined side surface (24). Side surface (24) truncates the lower end portion of the needle bar (12). A circumferential groove (34) is provided on the remaining part of the lower end portion of needle bar (12), closely adjacent a lower end surface (30). A chamfer (32) is provided at the periphery of the end surface (30). Chamfer (32) functions to cam a snap ring (36) onto the lower end portion of needle bar (12) and into the groove (34). The inclined side surface (24) and a confronting portion of ring (26) defines a thread guide eye (46).

12 Claims, 3 Drawing Sheets

THREAD GUIDE RING FOR A NEEDLE BAR

DESCRIPTION

1. Technical Field

This invention relates to a thread guide at the lower end of a needle bar for a sewing machine. More particularly, it relates to the provision of a thread guide in the form of an easily replaceable ring which snap fits into a circumferential groove provided at the lower end of the needle bar.

2. Background Art

A sewing machine functions to stitch together two or more thicknesses of material as they move along a path which includes a needle which is moving up and down. The needle moves an upper thread through the material so that it can be engaged by a lower thread below a bed which serves to support the material as it moves past the needle. The needle is connected to the lower end of a support which is termed a "needle bar." The needle bar includes a socket at its lower end into which an upper portion of the needle is received. A set screw within an opening extending perpendicular to the socket is commonly used for clamping the needle to the needle bar.

Some sort of thread guide is provided at the lower end of the needle bar. The upper thread extends downwardly from a take-up arm to and through this thread guide. Below the thread guide the upper thread extends downwardly to and through an opening in the needle provided adjacent the lower end of the needle. It is desirable that the thread guide place the upper thread as close to the needle as is possible. Known thread guides comprise a sleeve which is secured to the lower end of the needle bar and which carries or includes a guide opening for the thread. Typical examples of prior art thread guides for presser bars are shown by French Pat. No. 299,847, granted June 3, 1884 to Jules E. Pechard, and U.S. Pat. No. 2,692,569, granted Oct. 26, 1954 to Stanley J. Ketterer. The thread guide carrying sleeves disclosed by these patents are secured in place by a set screw. Each sleeve includes a thread guide having relatively sharp thread contacting surfaces.

A principal object of the present invention is to provide a very efficient thread guide which can be easily secured to and removed from the needle bar, which positions the thread closely adjacent the needle, and which presents a rounded bearing surface which it is contacted by the thread.

DISCLOSURE OF THE INVENTION

According to the invention, a needle bar is provided which at its lower end includes a lower end surface, a needle receiving socket penetrating the lower end surface and extending axially upwardly into the needle bar, a laterally extending set screw opening in the lower portion, intersecting the needle receiving socket, an inclined side surface intersecting the end surface and truncating the lower end portion of the needle bar, and a circumferential groove extending around the lower end portion of the needle bar in the region of the inclined side surface. A ring is snap fitted into the groove and surrounds the lower end portion of the needle bar. The inclined surface and a confronting portion of the ring, spaced laterally outwardly from the inclined surface, forms a thread guide. The ring has a substantially circular cross sectional configuration and thus provides a rounded bearing surface in contact with the thread.

The ring is a split ring so that it can easily be snapped into and removed from the groove. Preferably, the groove is located closely adjacent the lower end surface of the needle bar.

The lower end portion of the needle bar may be tapered and the inclined side surface and the circumferential groove formed in the tapered region. This construction allows the use of a smaller diameter ring and results in a closer placement of the upper thread to the upper portion of the needle.

According to an aspect of the invention, the thread guide is used in combination with a long slender needle which includes an axial groove extending along the side of the needle to which the upper thread is directed. The upper thread extends from a convex rounded guide surface, which is an upper inner surface region of the ring, downwardly to and then through the groove to and then to and through the opening at the lower end of the needle. The provision of a rounded bearing surface in contact with the thread reduces thread wear. Over a period of time the thread will tend to cut a slot in the bearing surface. When this happens, the ring can be easily removed from the needle bar and a new ring can be easily inserted in its place.

Other objects, features and advantages of the invention will be hereinafter described in detail as a part of the description of the best mode.

BRIEF DESCRIPTION OF THE DRAWING

Like reference numerals are used to designate like part throughout the several views of the drawing, and.

BEST MODE FOR CARRYING OUT THE INVENTION

Figure 3:
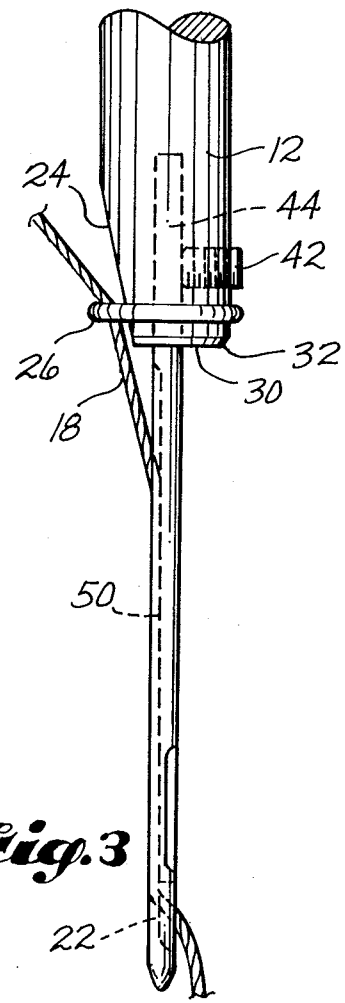
FIG. 3 is a front side elevational view of the needle and the lower portion of the needle bar, such view showing the upper thread angling outwardly as it extends upwardly from the thread guide ring and below the ring showing the upper thread entering a thread groove in the side of the needle and then extending downwardly to and then through an opening at the lower end of the needle.
Figure 2:
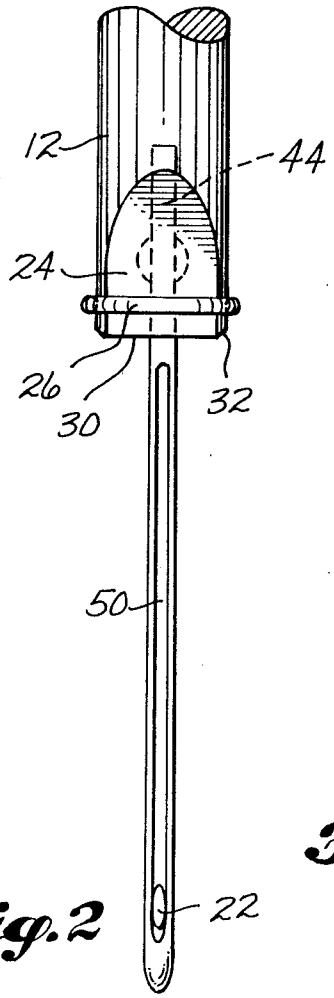
FIG. 2 is an end elevational view of the needle and a lower portion of the needle bar, such view showing a snap-on thread guide ring at the lower end of the needle bar.
Figure 1:
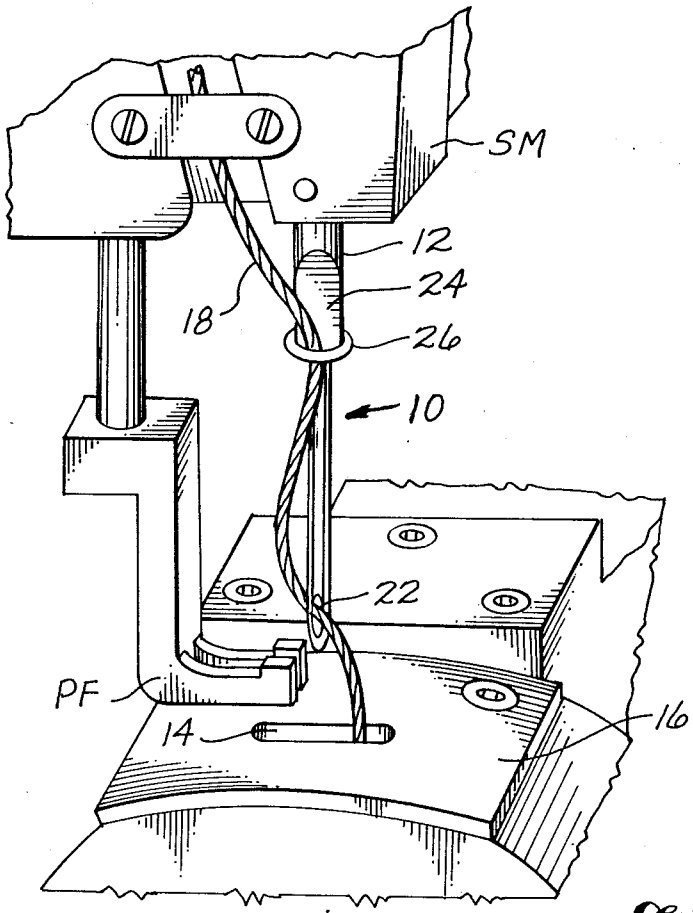
FIG. 1 is a pictorial view of the needle region of a sewing machine, taken from above and looking towards the needle end and the operator's side of the machine.

FIG. 1 shows a needle 10 secured at its upper end to a needle bar 12 which is moved up and down by sewing machine SM to in turn move the needle 10 up and down. The pointed lower end of the needle 10 is aligned with a slot 14 formed in a plate 16. Plate 16 functions as a support bed for the material M as it is moved forwardly relative to the needle. A pressure foot PF is located forwardly of the needle 10.

Figure 4:
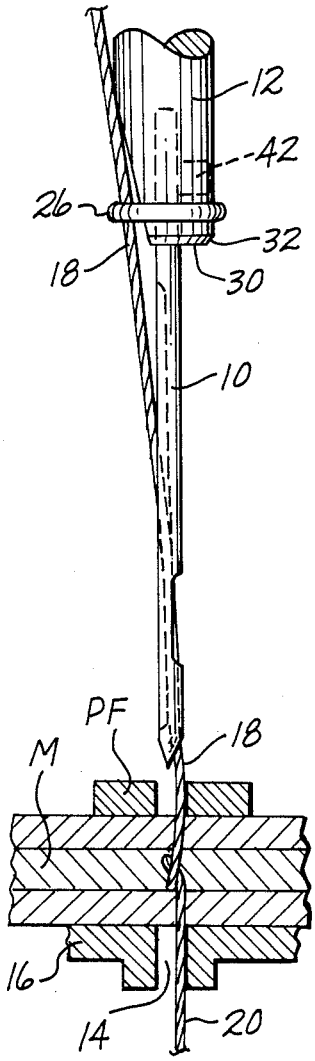
FIG. 4 is a view similar to FIG. 3, but on a smaller scale, and showing the needle elevated with respect to a workpiece.
Figure 5:
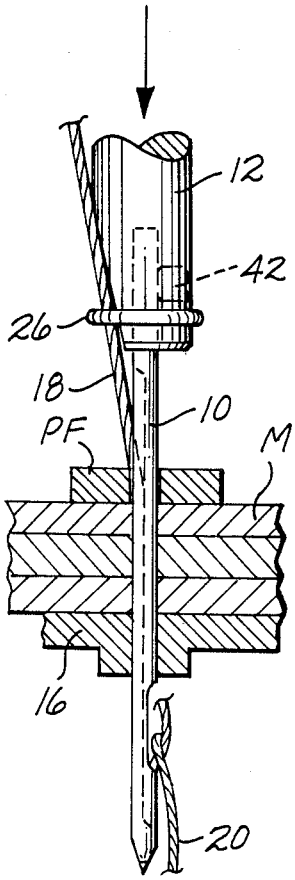
FIG. 5 is a view like FIG. 4, but showing the needle and needle bar moved downwardly, and the needle moved through the workpiece; and further showing a lower thread engaging the upper thread below the bed of the machine.
Figure 6:
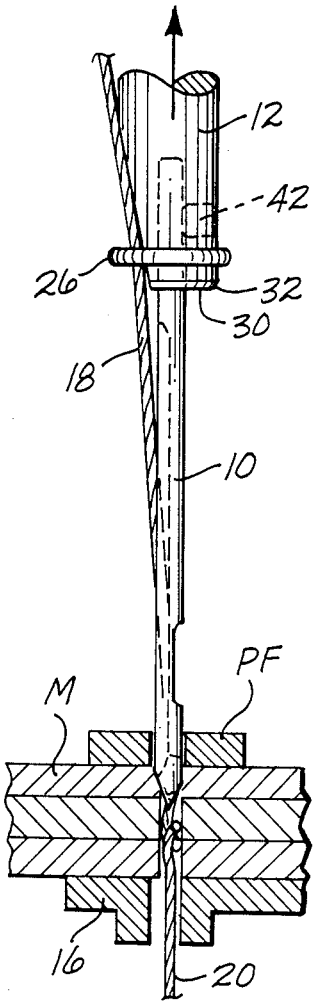
FIG. 6 is a view like FIGS. 4 and 5, but showing the needle in the process of moving upwardly.

As is well known, the needle 10 moves an upper thread 18 downwardly through the bed to a location below plate 16 where it becomes united with a lower thread 20 (FIGS. 4–6). Thread 18 comes from a spool (not shown) supported by an upper portion of the sewing machine SM. The path of the thread 18 from the spool to an opening 22 in the needle includes a thread guide at the lower end of the needle bar 12. If the thread guide were to be omitted, the thread 18 would extend upwardly from the needle opening or eye 22 at a substantial angle to the needle 10. During phases of the sewing operation, the upper thread 18 is in tension. Without a thread guide at the lower end of the needle bar 12, thread 18, when in tension, would exert a substantial lateral force on the needle 10, moving it out of alignment with the slot 14. The thread guide transfers a substantial amount of the lateral force to the needle bar 12 which is a relatively rigid member that is well-braced by bushings within the upper portion of the sewing machine SM.

It is desirable that the thread guide function to position the upper thread as close to the upper end of the needle 10 as is possible This is to reduce the angle between the thread 18 and the needle between the opening 22 and the thread guide. The purpose of the angle reduction is to minimize the lateral forces which are imposed on the needle 10.

According to the invention, the thread guide is defined by and between an inclined surface 24, provided on the lower end portion of the needle bar 12, and a confronting solid portion of a split ring 26. By way of typical and therefore nonlimitive example, the inclined side surface 24 may deflect inwardly from the side boundary 28 of the needle bar 12 at an acute angle X of about twelve to fifteen degrees (12°–15°).

Figure 8:
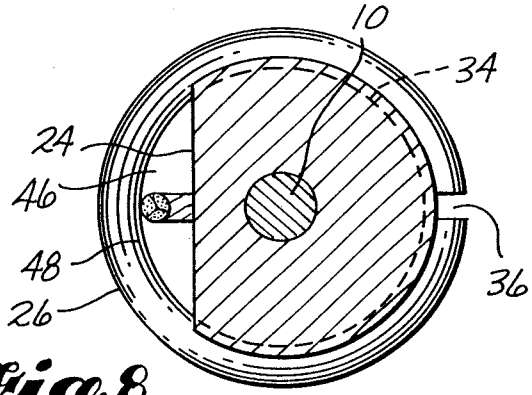
FIG. 8 is a cross sectional view taken substantially along line 8—8 of FIG. 7, such view showing a thread guiding passageway which is defined by and between the sloping side surface of the needle bar and a confronting portion of the thread guide ring.
Figure 7:
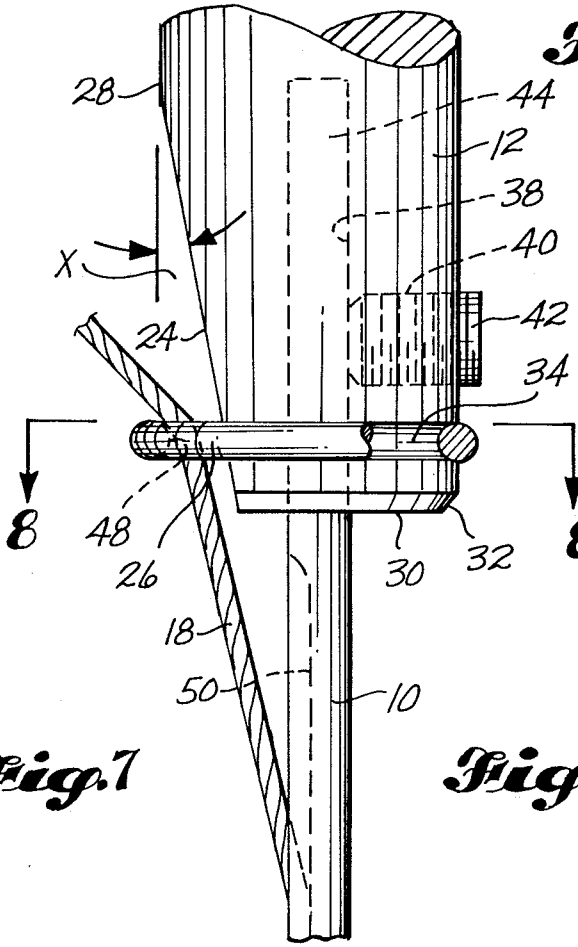
FIG. 7 is an enlarged scale fragmentary view of the upper portion of the needle and the lower portion of the needle bar, such view showing the thread guide ring in elevation.

The needle bar 12 is formed from a cylindrical rod. The lower end of the needle bar 12 includes an end surface 30. Preferably, a chamfer 32 is formed at the periphery of end surface 30. The inclined side surface 24 truncates the lower end portion of the needle bar 12. The remaining cylindrical portion of the needle bar 12 is provided with a circumferential groove 34 (FIGS. 7 and 8). As best shown by FIG. 8, the groove 34 is interrupted by the inclined surface 24. Thread guide ring 26 is a split ring. The split 36 is shown in FIG. 8. It is located away from the inclined side surface 24 so that the inclined side surface 24 is confronted by a solid (i.e. nonsplit) portion of the guide ring 26.

As best shown by FIG. 7, an axial blind socket 38 is formed in the lower end portion of the needle bar 12. Socket 34 penetrates the end surface 30. An internally threaded set screw receiving opening 40 extends through a side region of the needle bar 12. An externally threaded set screw 52 is received in opening 40. Set screw 42, when tightened, bears against the upper end portion 44 of the needle 10 and in that manner holds the needle 10 secure to the needle bar 12. The set screw opening 40 is shown to be positioned on the side of the needle bar 12 that is opposite the inclined surface 24.

Preferably, the guide ring 26 is positioned closely adjacent the end surface 30. In FIG. 7, it is shown to be positioned vertically between the set screw 42 and the chamfer 32.

FIG. 8 best shows the shape of the thread guide opening 46. In plan, it has a substantially D-shape and is bounded on one side by a straight boundary provided by surface 24, and at its opposite side by a circular boundary provided by the inner portion of ring 26.

Figure 11:
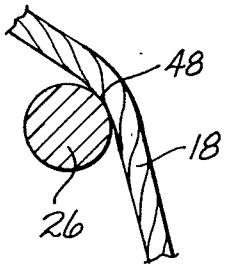
FIG. 11 is a magnified fragmentary sectional view of the thread guide ring where it contacts the upper thread.

As best shown by FIG. 11, guide ring 26 has a substantially circular cross-sectional shape. As a result, the inner surface portion 48 of ring 26, which is contacted by the thread 18, is of convex curvature in the vertical direction. As shown by FIG. 11, surface 48 provides a relatively long, smoothly curving bearing surface in contact with the thread 18. This arrangement minimizes wear on the thread 18 caused by movement of thread 18 along surface 48.

As shown by FIG. 7, the bearing surface 48 is positioned inwardly of the side boundary 28 of needle bar 12. As a result, the portion of thread 18 immediately below bearing surface 48 is closely adjacent the upper portion 44 of needle 10.

Owing to its split nature, guide ring 26 can be easily snap fitted into the groove 34. The chamfer 32 helps cam the ring 26 onto the needle bar 12. Ring 26 is aligned with the lower end of bar 12 and is moved upwardly into a seated position within the groove 34. The camming action of chamfer 32 expands the ring 26, to allow it to fit over the diameter of the bar 12 between chamfer 32 and groove 34. The ring 26 is slid upwardly until it snaps into the groove 34.

The curved nature of the bearing surface 48, in the direction of thread contact, minimizes both thread damage by abrasion and wear on surface 48. However, over a period of use, the thread 18 will start to cut a groove in the surface 48. When this happens, the worn ring 26 can be easily removed and replaced by a new ring 26. By way of example, the tip of a screwdriver can be inserted into the slot 36. The screwdriver can then be turned for the purpose of prying the worn ring 26 out from the groove 34.

The thread guide of the invention has particular application with a sewing machine adpated to sew relatively thick materials. This type of machine has a relatively long needle 10. Preferably, the needle 10 has a longitudinal groove 50 extending along the side of it which receives the thread 18. The thread guide 46 brings the thread 18 into close proximity with the upper end portion of groove 50. In its extent downwardly from guide eye 46 to needle eye 22, the thread 18 enters the groove 50 and lies within the groove 50 as the needle 10 moves through the material M.

Figure 10:
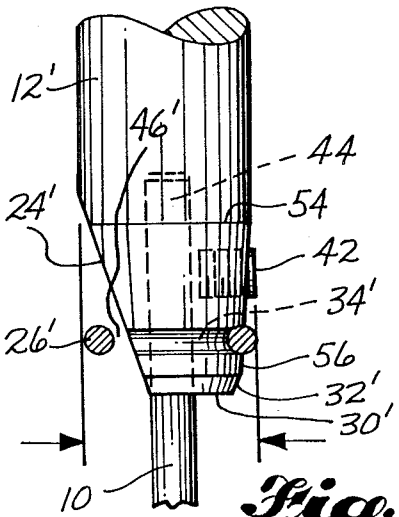
FIG. 10 is a view like FIG. 9, but taken from the aspect of FIG. 3, with the thread guide ring shown in section.
Figure 9:
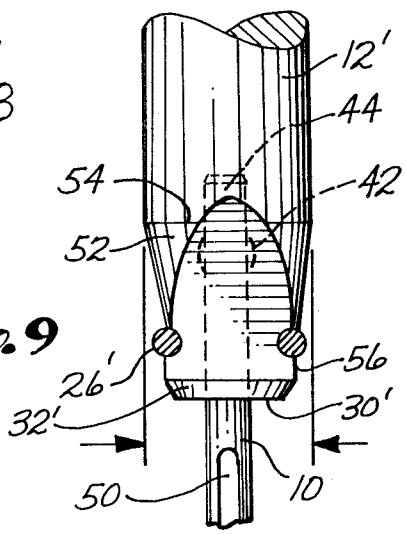
FIG. 9 is a fragmentary view taken from the aspect of FIG. 2, showing a modified embodiment of the needle bar, with the thread guiding ring being shown in section.

FIGS. 9 and 10 illustrate a modified embodiment In this embodiment, the needle bar is designated 12'. The lower end portion 52 of needle bar 12' is first tapered, i.e. its diameter is reduced from a first diameter at 54, which is the diameter of the main body portion of bar 12', to a smaller diameter 56 adjacent the chamfer 32'. The inclined side surface 24' is provided in the tapered region. As in the first embodiment, side surface 24' truncates the lower end portion of the needle bar 12'. The remaining part of the lower end portion is provided with a circumferential groove 34'. A split guide ring 26' is snap fitted into the groove 34'. The sloping surface 24' and a solid (i.e. nonsplit), confronting portion of the ring 26' together define a thread guide eye 46'. The tapering of the lower end portion of needle bar 12' makes it possible to use a smaller diameter ring 26' and places the guide eye 46' even closer to the needle 10 than in the first embodiment. The diameter of ring 26' is either about equal to or less than the diameter of the needle bar 12'.

The needle bar and thread guide combination which has been described is quite simple in construction and is easy to use. It consists of but two parts, the needle bar 12, 12' and the snap-on guide ring 26, 26'. Installation of a ring 26, 26' is very easy. It is merely a "snap-on" operation, with the chamfer 32, 32' serving to assist movement of the ring 26, 26' onto the needle bar 12, 12' The ring 26 is very inexpensive. Thus, when it wears to the extent that it needs to be replaced, the user need only disregard a very inexpensive part, i.e. the ring 26, 26'. The relatively expensive needle bar 12, 12' is not affected by the thread-caused wear and has a very long use life. The "snap-on" installation of the thread guide eliminates the need for a second set screw or the inconvenience of using a common set screw for connecting the thread guide and the needle to the needle bar.

It is to be understood that while the embodiments of the invention which have been illustrated are preferred embodiments, and constitute the best mode of the invention at the time of filing, the invention is not to be limited to the disclosed details but is to be determined by the following claims, interpreted in accordance with established rules of patent claim interpretation, including use of the doctrine of equivalents.

What is claimed is:

1. For use in a sewing machine, a needle bar comprising:

an elongated body having a lower end portion including a lower end surface, a needle receiving socket penetrating said end surface and extending axially upwardly into said lower end portion, a laterally extending set screw opening in said lower portion, intersecting the needle receiving socket, and in which a set screw may be received for applying a clamping pressure on a needle positioned within the needle receiving socket, an inclined side surface intersecting the end surface and truncating the lower end portion of the needle bar, and a circumferential groove extending about the lower end portion of the needle bar in the region of the inclined side surface; and a split ring within said groove, said ring surrounding the lower end portion of the needle bar, with said inclined surface and a confronting solid portion of the ring spaced laterally outwardly from said inclined side surface forming a thread guiding eye.

2. A needle bar according to claim 1, wherein said ring has a substantially circular cross-sectional configuration.

3. A needle bar according to claim 1, wherein said lower end portion of the needle bar is substantially circular in cross section except in the region of the inclined side surface.

4. A needle bar according to claim 1, wherein the lower end portion is tapered and the needle bar includes a cylindrical portion above the lower end portion which is of a predetermined diameter, and wherein said ring has an outside diameter which is equal to or less than the diamter of said cylindrical portion.

5. A needle bar according to claim 4, wherein said ring has a substantially circular cross-sectional configuration.

6. In a sewing machine:

a needle bar comprising an elongated body having a lower end portion including a lower end surface, a needle receiving socket penetrating said end surface and extending axially upwardly into said lower end portion, a threaded, laterally extending set screw opening in said lower portion, intersecting the needle receiving socket, an inclined side surface intersecting the end surface and truncating the lower end portion of the needle bar, and a circumferential groove extending around the lower end portion of the needle bar in the region of the inclined side surface;

a needle having an upper end positioned within said needle receiving socket;

a set screw in said set screw opening, applying a clamping pressure on the needle to in that manner connect the needle to the needle bar; and a split ring within said groove surrounding the lower end portion of the needle bar, with said inclined surface and a confronting solid portion of the ring spaced laterally outwardly from said inclined surface forming a thread guiding eye.

7. The assembly of claim 6, wherein said needle includes a pointed lower end, a through eye above and adjacent the pointed lower end, and a thread groove extending axially upwardly along the needle from the through eye in the needle to the eye formed by and between the ring and the inclined side surface of the needle bar.

8. The assembly of claim 7, wherein said ring has a substantially circular cross-sectional configuration.

9. The assembly of claim 6, wherein said ring has a substantially circular cross-sectional configuration.

10. The assembly of claim 6, wherein said lower end portion of the needle bar is substantially circular in cross section except in the region of the inclined side surface.

11. The assembly of claim 6, wherein the lower end portion is tapered and the needle bar includes a cylindrical portion above the lower end portion which is of a predetermined diameter, and wherein said ring has an outside diameter which is equal to or less than the diameter of said cylindrical portion.

12. The assembly of claim 11, wherein said ring has a substantially circular cross-sectional configuration.

* * * * *